US012140310B2

(12) United States Patent
Muselmann et al.

(10) Patent No.: US 12,140,310 B2
(45) Date of Patent: Nov. 12, 2024

(54) METHOD OF MONITORING A BURNER AND/OR A BURNING BEHAVIOR OF A BURNER AND BURNER ASSEMBLY

(71) Applicant: TRUMA GERÄTETECHNIK GMBH & CO. KG, Putzbrunn (DE)

(72) Inventors: Wolfgang Muselmann, Putzbrunn (DE); Kai Armesto-Beyer, Putzbrunn (DE); Craig Hawthorne, Putzbrunn (DE)

(73) Assignee: TRUMA GERÄTETECHNIK GMBH & CO. KG, Putzbrunn (DE)

( * ) Notice: Subject to any disclaimer, the term of this patent is extended or adjusted under 35 U.S.C. 154(b) by 467 days.

(21) Appl. No.: 17/593,225

(22) PCT Filed: May 6, 2020

(86) PCT No.: PCT/EP2020/000091

§ 371 (c)(1),
(2) Date: Sep. 13, 2021

(87) PCT Pub. No.: WO2020/228979

PCT Pub. Date: Nov. 19, 2020

(65) Prior Publication Data

US 2022/0128235 A1 Apr. 28, 2022

(51) Int. Cl.

| | |
|---|---|
| ***F23N 5/12*** | (2006.01) |
| ***F23M 11/04*** | (2006.01) |
| ***F23N 1/00*** | (2006.01) |
| ***F23N 5/20*** | (2006.01) |
| ***F24H 9/20*** | (2022.01) |

(52) U.S. Cl.
CPC ..... *F23N 5/123* (2013.01); *F23N 1/002* (2013.01); *F24H 9/2035* (2013.01); *F23N 2229/12* (2020.01); *F23N 2241/06* (2020.01); *F23N 2900/05005* (2013.01)

(58) Field of Classification Search
CPC ..... F23N 5/123; F23N 1/002; F23N 2229/12; F23N 2241/06; F23N 2900/05005; F23N 5/203; F24H 9/2035; F23M 11/04
USPC ..... 431/25
See application file for complete search history.

(56) References Cited

U.S. PATENT DOCUMENTS

2018/0209648 A1* 7/2018 Fernandes Garcia Lima ..... F23N 3/082

FOREIGN PATENT DOCUMENTS

| | | | | |
|---|---|---|---|---|
| DE | 20112299 U1 | | 10/2001 | |
| DE | 102017126137 A1 | * | 5/2019 | ..... F23N 1/022 |
| JP | 2004301437 A | * | 10/2004 | ..... F23N 1/002 |
| WO | WO-2013032324 A1 | * | 3/2013 | ..... F23N 1/002 |

* cited by examiner

*Primary Examiner* — Allen R. B. Schult
*Assistant Examiner* — William C Weinert
(74) *Attorney, Agent, or Firm* — McNees Wallace & Nurick LLC

(57) ABSTRACT

This invention relates to a method of monitoring a burner (2) and/or a burning behavior of a burner (2) by means of a measured ionization signal. The invention consists in that the ionization signal is measured between an ionization electrode (4, 4') and a counter-electrode (3) spaced apart from a burner surface (2') of the burner (2). Furthermore, the invention relates to a burner assembly.

4 Claims, 5 Drawing Sheets

METHOD OF MONITORING A BURNER AND/OR A BURNING BEHAVIOR OF A BURNER AND BURNER ASSEMBLY

FIELD OF THE INVENTION

This invention relates to a method of monitoring a burner and/or a burning behavior of a burner. There is measured an ionization signal, and the measured ionization signal is used for monitoring the burner. Preferably, the method also is used for controlling the burner or the burning behavior of the burner. Furthermore, the invention relates to a burner assembly comprising a burner, a heat exchanger, at least one ionization electrode, an air-fuel mixture supply unit for the burner, and a control device. The control device is connected to the ionization electrode and, based on ionization signals measured by means of the at least one ionization electrode, monitors the burner and/or a burning behavior of the burner. The burner preferably is a gas burner.

TECHNICAL BACKGROUND

The basic construction of a burner assembly comprising a burner, a surrounding heat exchanger and an ionization electrode is disclosed for example in EP 2 017 531 B1. In such a burner, an air-fuel mixture (or alternatively: an air-gas mixture) is burnt (see also e.g. DE 34 15 946 C2). The fuel for example is propane, butane or e.g. diesel transferred into the gaseous state, or a mixture of these components. In the burning process, the flame extends from the burner surface.

To monitor the presence of a flame or also the burning quality itself, and on this basis to preferably control the behavior of the burner or the burning process, it is known in the prior art to use so-called ionization electrodes. The construction and the use of ionization electrodes for monitoring or detecting a flame are described e.g. in EP 1 036 984 A1, EP 1 707 880 A1, DE 10 2010 055 567 B4 or EP 2 357 410 A2. Further measuring arrangements can be found for example in WO 2016/140681 A1, DE 201 12 299 U1, DE 198 17 966 A1, DE 10 2017 204 014 A1, DE 10 2010 046 954 A1 or DE 102 20 773 A1. The control of the burning behavior subsequent to the measurement is effected for example by controlling the excess-air coefficient. This is done with the objective to ensure a safe, clean and efficient combustion, for example in fully premixing surface burners. For example, a gas valve and a combustion air blower are controlled separately in dependence on the ionization signal (i.e. the ionization voltage and/or the ionization current).

The aforementioned method of monitoring the presence of a flame in a gas burner relies on the ionization effect of a flame. In an area in which the flame should be located, an alternating voltage is applied either via two electrodes or via an electrode and a ground electrode. When a flame is burning in this area, this produces a rectifier effect on the alternating voltage, which in turn produces a current flow e.g. from the ground to the ionization electrode. This current flow is detected by an electronic measuring system and can be provided in the form of an ionization voltage as a measure for the actually occurring ionization current. In most cases, a limit value is specified for the measured ionization voltage, the exceedance of which is interpreted as the presence of a flame and the falling below of which is interpreted as meaning that no flame is burning. In general, an ionization signal hence is determined, which can represent a voltage or a current depending on the configuration.

It is known to use the surface of the burner (i.e. the burner surface), from which the flame extends, as electrical ground.

The ionization electrode is mounted relative to this surface or to this ground electrode. What is decisive for the measurement of the ionization voltage is the position of the electrode relative to the flame or to the burner surface.

Gas burners and in particular blower-operated gas burners frequently are exposed to changing environmental conditions which can lead to a variable burning behavior. Such environmental parameters include for example the air pressure, temperature of the incoming combustion air, gas pressure (i.e. the pressure at which the fuel gas is supplied), type of gas and also the energy value of the gas. It is to be taken into account that the composition of the fuel gas frequently can vary. For example, in typical gas mixtures such as LPG (Liquefied Petroleum Gas; autogas) or typical propane/butane mixtures the composition can be variable. Depending on the gas supply it is possible that pure propane, pure butane or also an undefined propane/butane mixture is supplied.

Thus, due to the variable environmental parameters it is possible that the gas burner is not operated at the optimum operating point at which the fuel is burnt optimally and the emission of pollutants is minimal. When such a ratio between fuel gas and (air) oxygen is given, so that a complete combustion takes place by the fuel gas reacting completely with the (air) oxygen, reference is made to a stoichiometric combustion, which corresponds to lambda=1. When the value of lambda is less than 1, i.e. sub-stoichiometric, this means that the air-fuel mixture is such that a rich, incomplete combustion under oxygen deficiency is given. When the value of lambda is greater than 1, i.e. over-stoichiometric, the combustion theoretically is effected in the presence of excess air. In the technical combustion, different lambda ranges are used for a clean and low-pollution combustion depending on the field of application. In fully mixing gas burners, a range from lambda=1.2 to lambda=1.5 often is used. In this lambda range, the combustion is effected completely and hygienically. Combustion outside these limits leads to a educed efficiency and an increased emission of harmful exhaust gas components.

EP 0 770 824 B1 provides that proceeding from a lean, over-stoichiometric burner operation, the excess of air is reduced until a sub-stoichiometric combustion is achieved. For this purpose, the ionization voltage between an ionization electrode and the burner surface is measured. As the ionization voltage is maximal with a stoichiometric combustion, the ionization voltage initially increases in the described method when the excess of air is reduced. When the ionization voltage subsequently decreases after reaching the maximum, this is a sign that the combustion is sub-stoichiometric.

The qualitative course of the ionization signal generally shows reproducibly characteristic features in the relevant lambda range. The absolute values, however, can be subject to deviations. For example, the absolute value of the ionization voltage is dependent on the position of the ionization electrode (another term also is ionization candle), on ageing properties, on the constitution of the fuel or also on the altitude at which the burning process takes place. Therefore, a calibration of the measurement arrangement is expedient in order to utilize the ionization signal as a control variable for combustion control.

The calibration for example consists in finding the aforementioned maximum of the ionization voltage by varying the mixing ratio in that an enrichment of the air-fuel mixture is performed. The combustion is incrementally set richer until the maximum voltage is determined, in that a blower for the combustion air is running at a lower speed or a valve allows more gas to flow in. Alternatively, it is known to perform a calibration by leaning the gas-air mixture (see e.g. EP 2 014 985 A2).

In particular, approaching the rich or sub-stoichiometric range involves the disadvantage of the increased formation of carbon monoxide, the increased ageing of the burner surface or e.g. also the increased formation of soot.

SUMMARY OF THE INVENTION

The object underlying the invention consists in proposing a method of monitoring a burner and a corresponding burner assembly comprising a burner to be monitored in such a way, which represent an alternative to the prior art.

The invention achieves the object by a method which is characterized in that the ionization signal is measured between an ionization electrode and a counter-electrode spaced apart from a burner surface of the burner.

Monitoring for example consists in that an amount for an ionization voltage or an ionization current is determined from the ionization signal measured relative to the counter-electrode and at a known lambda value, and that this value is compared with a setpoint value. When the determined value deviates from the setpoint value beyond a tolerance range, a correction of the air-fuel mixture is made, e.g. the air content is increased or reduced. In one of the following embodiments it is described how such a setpoint value is determined or how the method is subjected to calibration.

The method serves to monitor a burner or especially the burning behavior of a burner. Preferably, the method serves to monitor or control the combustion of the air-fuel mixture by the burner, i.e. the burning behavior of the burner. In one of the following embodiments the method also comprises a calibration or determination of the parameters used for monitoring.

The burner preferably is a fully premixing surface burner.

In the prior art the burner, or especially the burner surface from which the flames generated during the combustion extend, serves as a counter-electrode with respect to which the ionization signal (hence e.g. the ionization voltage or the ionization current) is measured. However, in the method according to the invention this is effected via a counter-electrode spaced apart from the burner surface. Thus, the counter-electrode above all does not form part of the burner and—depending on its configuration—is galvanically separated from the burner and in particular from the burner surface.

The idea consists in that an electric ionization signal (i.e. depending on the configuration an electric voltage or an electric current) is measured between the ionization electrode and a counter-electrode spaced apart from the burner surface. The ionization signal measured in this way is then used to determine whether the burning process is taking place optimally and whether it may be necessary to intervene in a regulating manner on the burner or on the entire burner assembly.

In a possible embodiment, the counter-electrode is a heat exchanger at least partly surrounding the burner surface. The heat exchanger or e.g. an inner housing of the heat exchanger facing the burner surface is at least partly electrically conductive. In one embodiment, the heat exchanger serves to achieve that the thermal energy of the flue gas generated during the combustion is transmitted to a fluid, e.g. water.

Depending on the embodiment, a single ionization electrode is used, which as compared to the prior art is further away from the flame region—i.e. in particular from the burner surface—, or at least two ionization electrodes are used—for example at different distances to the burner surface—for measuring ionization signals. In the measurement with only one ionization electrode, the same in one embodiment preferably is disposed centrally between the burner surface and the heat exchanger housing, as an example for the counter-electrode different from the burner.

In one variant, a spark plug is used both for igniting the burning process of the burner and as an ionization electrode.

In one embodiment—based on the at least one ionization signal—a supply of the burner with an air-fuel mixture is acted upon. For example, the air supply or the fuel supply is changed. Alternatively or additionally, a composition of an air-fuel mixture, which is supplied to the burner, is acted upon, e.g. changed.

One embodiment provides that the ionization signal is measured between the ionization electrode and the counter-electrode by electrically connecting the counter-electrode to ground.

In addition to the measurement of an ionization signal between ionization electrode and counter-electrode, an—additional or supplementary—ionization signal in one embodiment is measured between the ionization electrode and a burner surface of the burner. Thus, this ionization signal preferably is used for monitoring the burner as a supplement to the ionization signal between ionization electrode and counter-electrode.

With the aforementioned separate ionization signals, the burner surface or generally the burner and the counter-electrode are galvanically separated from each other, i.e. electrically isolated from each other.

In another embodiment, a kind of mixed ionization signal (possibly as a supplementary signal in addition to an ionization signal measured between ionization electrode and counter-electrode) is measured in that the heat exchanger—or a heat exchanger housing—and the burner—or preferably the burner surface—are electrically connected to ground and preferably to the same ground.

Thus, depending on the embodiment, the different ionization signals are obtained from the following measurement arrangements: The ionization signal is measured between ionization electrode and counter-electrode, wherein the burner surface is electrically isolated from the counter-electrode. Alternatively or additionally, the ionization signal is measured between counter-electrode and burner surface on the one hand, which both are connected to each other or are each connected to ground, and the ionization electrode on the other hand. In another embodiment,—as is usual in the prior art—a (preferably supplementary) ionization signal is measured between the ionization electrode and the burner surface connected to ground and electrically isolated from the counter-electrode. In one embodiment, the counter-electrode is formed in particular by a heat exchanger surrounding the burner surface.

In one embodiment, ionization signals are recorded via ionization electrodes located at different positions.

In particular for measuring the ionization signal between the ionization electrode and the counter-electrode there is used an ionization electrode which is located in an area around the mean distance between the burner (or especially the burner surface) and the counter-electrode. In one embodiment, the area is located within plus or minus 20% to the mean distance. In another embodiment, the area is located within plus or minus 10% relative to the mean distance. The ionization electrode used for measuring the ionization signal in one embodiment in particular is located closer to the counter-electrode than to the burner surface.

When using the ionization signals, as explained already with respect to the prior art, it is advantageous and safety-relevant to perform calibrations or to determine the parameters (e.g. setpoint or limit values) used for monitoring and preferably for controlling the burning behavior at least occasionally or at least during an initial installation.

When the ionization signals between ionization electrode and spaced counter-electrode now are determined like in the method of the invention, this allows the following method steps, the great advantage consisting in that the calibration or determination of parameters takes place in the leaned area. Among other things, this reduces the environmental impact.

One embodiment of the method provides that for a calibration and/or for a determination of parameters used when monitoring the burner, ionization signals are measured during a over-stoichiometric combustion, and that a local extremum (e.g. a minimum of the amount) of the ionization signal is determined in dependence on a lambda value of an air-fuel mixture supplied to the burner and used for the calibration or the determination.

For a calibration or determination of necessary parameters or possibly for a parameter correction (e.g. of the aforementioned setpoint value for the amplitude of the ionization signal) measurements of the ionization signal in this embodiment thus are made in the leaned area, i.e. with an excess of air. The ratio of air and fuel is varied—preferably only—in the leaned area (i.e. the lambda value is changed) and the respective ionization signals are measured and evaluated. In particular a local extremum of the ionization signal is determined in dependence on the lambda value. This extremum subsequently is used for calibration or for determining the possibly required parameter adaptation.

In the aforementioned steps it is advantageous that the measurements are made in the gentle lean range. The measurements of the ionization signal preferably are made between at least one ionization electrode and the counter-electrode spaced apart from the burner. Depending on the sign of the measured ionization signal or depending on how—e.g. by considering the amount—the ionization signal is evaluated, the local extremum is a minimum or a maximum.

Reference here is made to the fact that many experiments have shown that the ionization signals measured relative to the described counter-electrode reveal a particular course in the leaned area, which does not occur in the measurement according to the prior art and which allows to perform the calibration or the determination of the parameters.

Therefore, in this method step a local extremum of the measured ionization signals over lambda is determined in the range of the lean air-fuel mixture (i.e. with a lambda value greater than 1). In one embodiment, this extremum then is approached for calibration. Subsequently, the lambda value is reduced by a specified value for example by reducing the speed of the combustion air blower in order to thereby achieve a desired combustion process.

It was found that the extremum lies in such a range of the lambda value in which a critical combustion instability need not yet be reckoned with.

Alternatively or additionally, it is provided in one embodiment that for a calibration and/or for a determination of the parameters used when monitoring the burner, ionization signals are measured via at least two ionization electrodes, wherein the ionization electrodes are located at different distances to a burner surface of the burner and/or the counter-electrode. The ionization signals are measured—preferably by varying the lambda value of the air-fuel mixture supplied to the burner—in such a way that at least the counter-electrode is connected to ground.

In one embodiment, the ionization signals are measured with different lambda values. In an accompanying embodiment, an intersection of the two curves (i.e. the dependence e.g. of the amplitude of the ionization signal on the lambda value) is used for calibration or for determining the parameters. In this variant, too, the measurements in one embodiment preferably are made only in the over-stoichiometric range.

Furthermore, the invention achieves the object by a burner assembly which is characterized in that for monitoring—and/or controlling—the burner and/or a burning behavior of a burner, the control device uses at least one ionization signal measured between the ionization electrode and the heat exchanger as a counter-electrode.

The embodiments of the method preferably are carried out by the burner assembly so that the respective explanations also apply for the variants of the burner assembly. In particular, the control device allows the monitoring or control by implementing at least one of the preceding embodiments of the method.

One embodiment provides that the ionization electrode is arranged in an area around a mean distance between a burner surface and the heat exchanger.

In another embodiment, the ionization electrode is arranged in an area of plus/minus 20% around the mean distance between a burner surface and the heat exchanger. Hence, when the mean distance is M, the ionization electrode in this embodiment is located in an area between 0.8*M and 1.2*M.

An alternative or supplementary embodiment includes the fact that for a calibration and/or for a determination of parameters used when monitoring the burner, the control device leans the air-fuel mixture supplied to the burner via the air-fuel mixture supply unit, and evaluates ionization signals measured by means of the leaned air-fuel mixture.

Another embodiment provides that for the calibration or the determination of the parameters the control device determines a local extremum of the ionization signals.

In one variant, an ionization electrode additionally is used for the classical flame monitoring and/or as a spark plug for starting a burning process.

BRIEF DESCRIPTION OF THE DRAWINGS

In detail, there is a wide variety of possibilities for designing and further developing the method and the burner assembly according to the invention. On the one hand, reference is made to the claims subordinate to the independent claims, and on the other hand to the following description of exemplary embodiments in conjunction with the drawing. In the drawing:

DETAILED DESCRIPTION OF PREFERRED EMBODIMENTS

Figure 1:
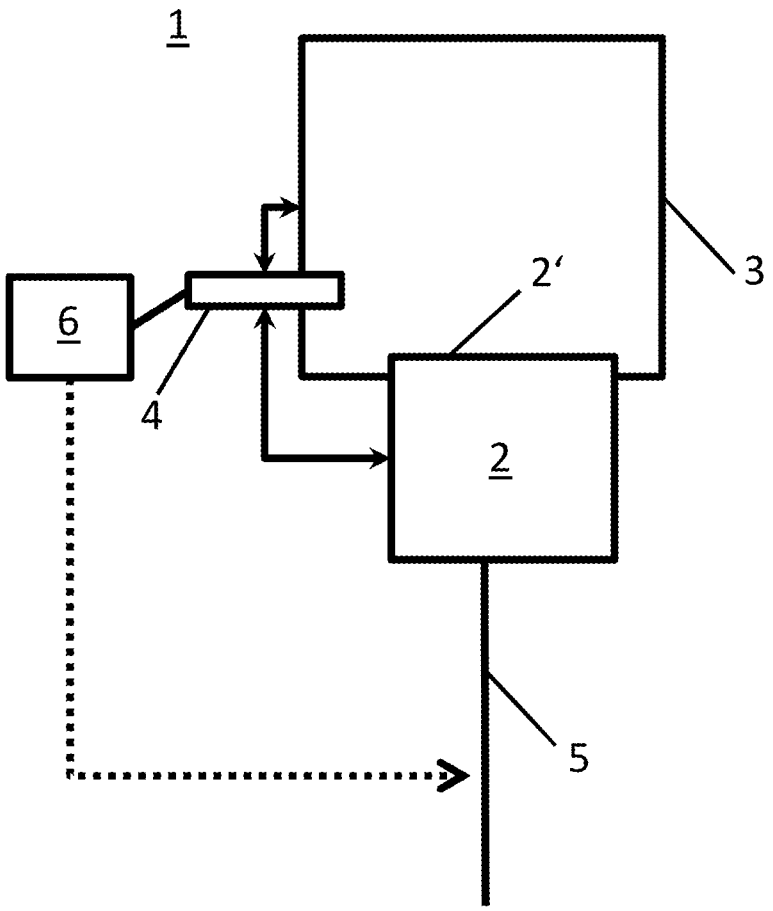
FIG. 1 shows a schematic block circuit diagram of a burner assembly according to the invention.

FIG. 1 schematically shows a burner assembly 1 comprising a burner 2 to which an air-fuel mixture is supplied via an air-fuel mixture supply unit 5. The fuel for example is a combustible gas such as propane or butane, or diesel that has been transferred into the gaseous state.

The air-fuel mixture is burnt by the burner 2, wherein here a—non-illustrated—flame is formed above the burner surface 2' of the burner 2.

The burner surface 2' is surrounded by a heat exchanger 3 in which the heat generated by the burning process—in the form of the flame and the flue gas generated—is transmitted to another medium, e.g. to water or a glycol-water mixture.

The heat exchanger 3 is designed to be electrically conductive at least partly and preferably on the inside facing the burner surface 2'. This conductivity allows to electrically connect the heat exchanger 3 to ground or to measure the ionization voltage via the at least one ionization electrode 4 opposite the heat exchanger 3.

For monitoring or controlling the burning process—in the illustrated embodiment—only one ionization electrode 4 is used, by means of which an ionization signal (here for example the ionization voltage) is measured. Alternatively, an ionization current can be measured.

For measuring the voltage (alternatively the current), either the burner surface 2' of the burner 2 or the aforementioned, at least partly electrically conductive inner surface of the heat exchanger 3 is connected to ground so that the ionization electrode 4 is used for measuring the ionization voltage with respect to the burner 2 or with respect to the heat exchanger 3. In one embodiment it is also provided that the heat exchanger 3 and the burner surface 2' are connected to the same ground so that the ionization signal is measured by the ionization electrode 4 opposite both of them as a counter-electrode.

Depending on the variant or method step, the ionization signal thus is measured by the at least one ionization electrode 4 by using the burner surface 2', by using the heat exchanger 3 as a single counter-electrode, or by using the burner surface 2' and the heat exchanger 3 as a common counter-electrode. These three ionization signals measured in different ways then are processed individually or jointly and used for monitoring the burner 2 or as a control variable of the burning behavior of the burner 2.

In one embodiment, the burner surface 2' and the heat exchanger 3 are connected to the same ground so that the ionization signal is measured with respect to the burner surface 2' and the heat exchanger 3. The possibilities between which components the electrical voltage is measured are indicated by the double arrows in the Figure.

The ionization electrode 4 is connected to the control device 6, which evaluates or processes the measurement signal (i.e. the ionization signal) and which acts on the air-fuel mixture supply 5 unit proceeding from the measured values. This is effected e.g. by regulating the fuel quantity or e.g. by controlling an air-conveying blower not shown here. The action of the control device 6 on the control of the burning process is indicated by the dashed arrow.

In one embodiment, the control device 6 acts on a—non-illustrated—starting device for starting a burning process, in case the ionization signal e.g. reveals that no flame is burning. Thus, the assembly 1 also allows monitoring of the flame.

Figure 2:
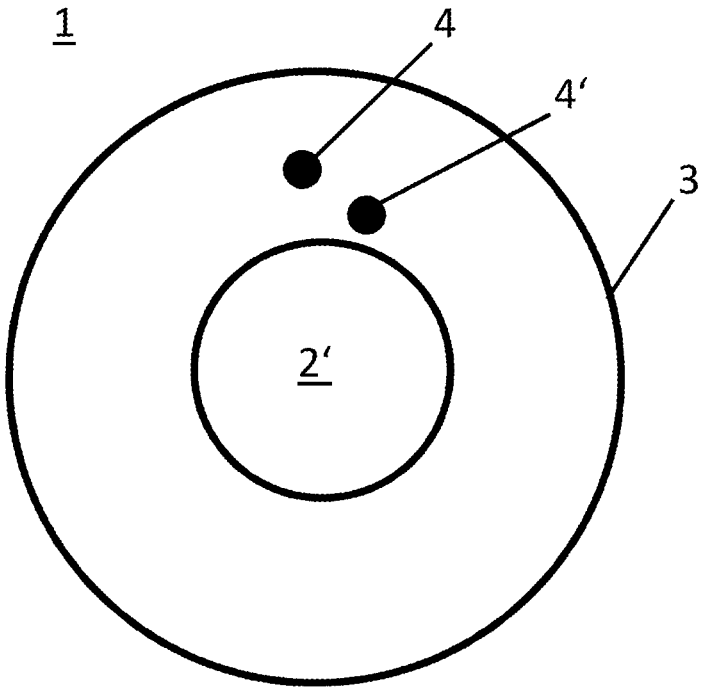
FIG. 2 shows a section through a schematic block circuit diagram of an alternative embodiment of a burner assembly according to the invention.

The section of FIG. 2 shows a burner assembly 1 comprising two ionization electrodes 4, 4' which are radially located at different distances between the burner surface 2' and the inside of the heat exchanger 3. It can be seen that in this embodiment the burner surface 2' has a circular cross-section that is surrounded by the inner wall of the circular cylindrical heat exchanger 3. The representation is not true to size.

In one embodiment, the burner surface 2' has a diameter of 50 mm, wherein the distance between the burner surface 2' and the inner edge of the heat exchanger 3 is 38 mm. The two ionization electrodes 4, 4' in this exemplary embodiment have a distance between 5 mm and 9 mm (for the ionization electrode 4' located closer to the burner surface 2') or between 14 mm and 22 mm (for the ionization electrode 4 located further away from the burner surface 2') to the outer surface of the burner surface 2'.

The position of the inner ionization electrode 4' corresponds to the design known in the prior art. The small distance to the burner surface 2' has the advantage that the probability is high that the ionization electrode 4' projects directly into a flame. Thus, this relates in particular to the use of the ionization electrode 4' for flame detection.

The radially further outer ionization electrode 4 here is located in an area around a mean distance between the burner surface 2' and the inner edge of the heat exchanger 3.

For measuring the ionization signal, the inner wall of the heat exchanger 3 in one variant is connected to ground and the electrical ionization signal is measured via the ionization electrode 4 with respect to this ground.

Figure 3:
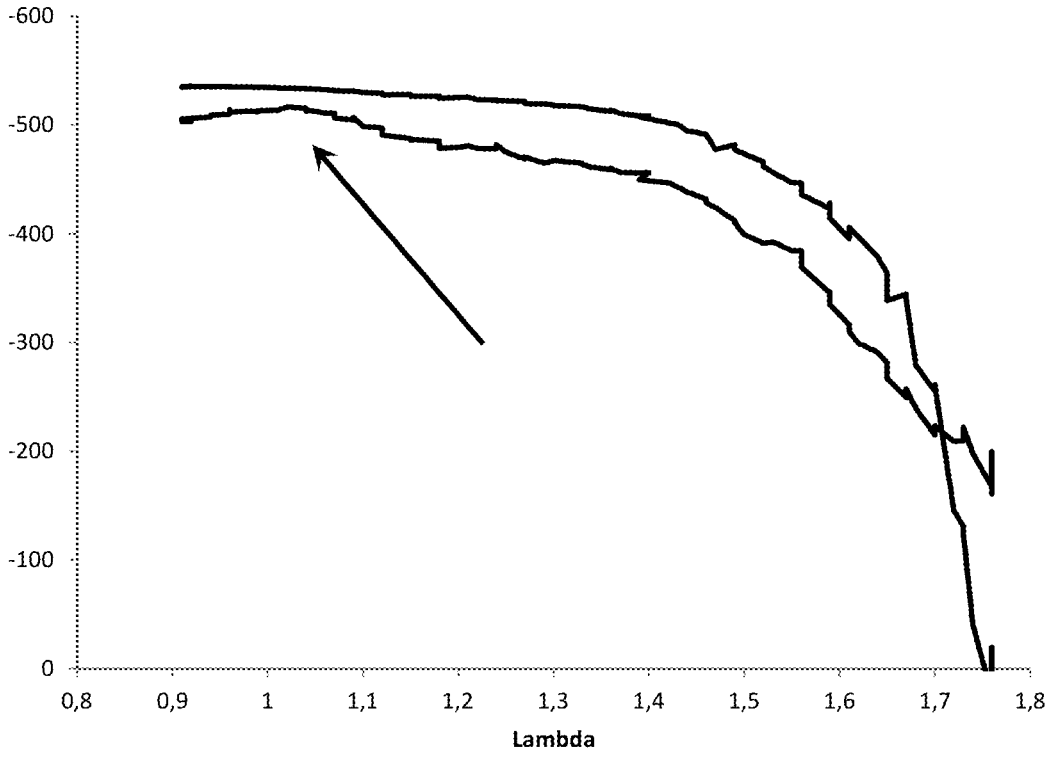
FIG. 3 shows two measurement curves of the ionization voltage for two ionization electrodes at different distances to the burner surface, wherein only the burner surface is connected to ground.
Figure 4:
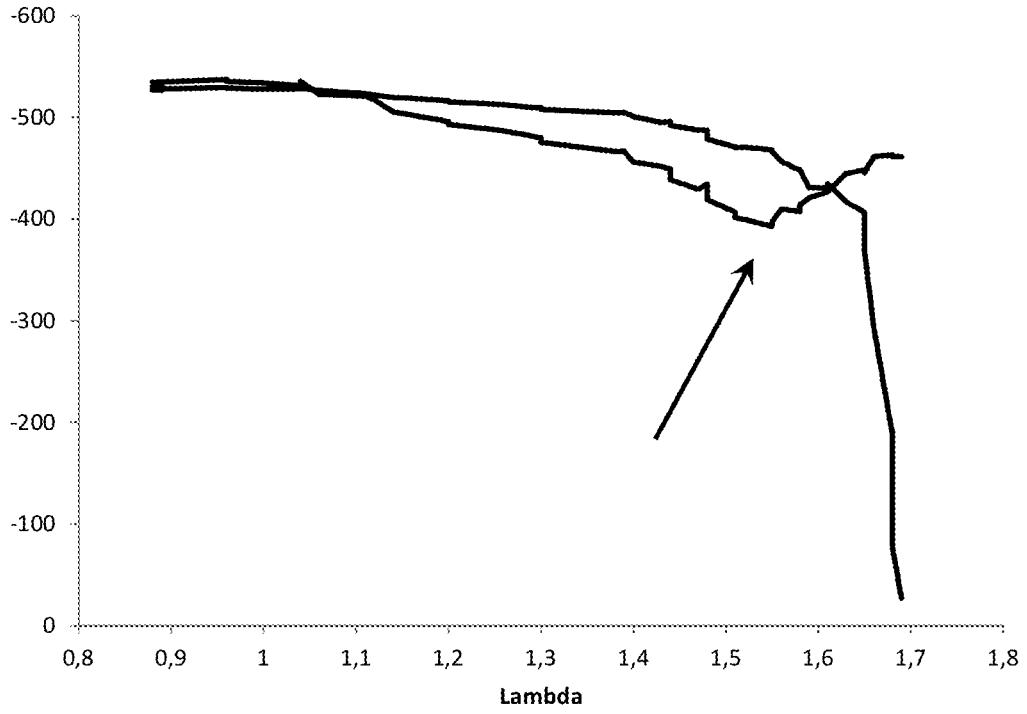
FIG. 4 shows two measurement curves of the aforementioned two ionization electrodes, wherein the burner surface and the surrounding heat exchanger are connected to ground.
Figure 5:
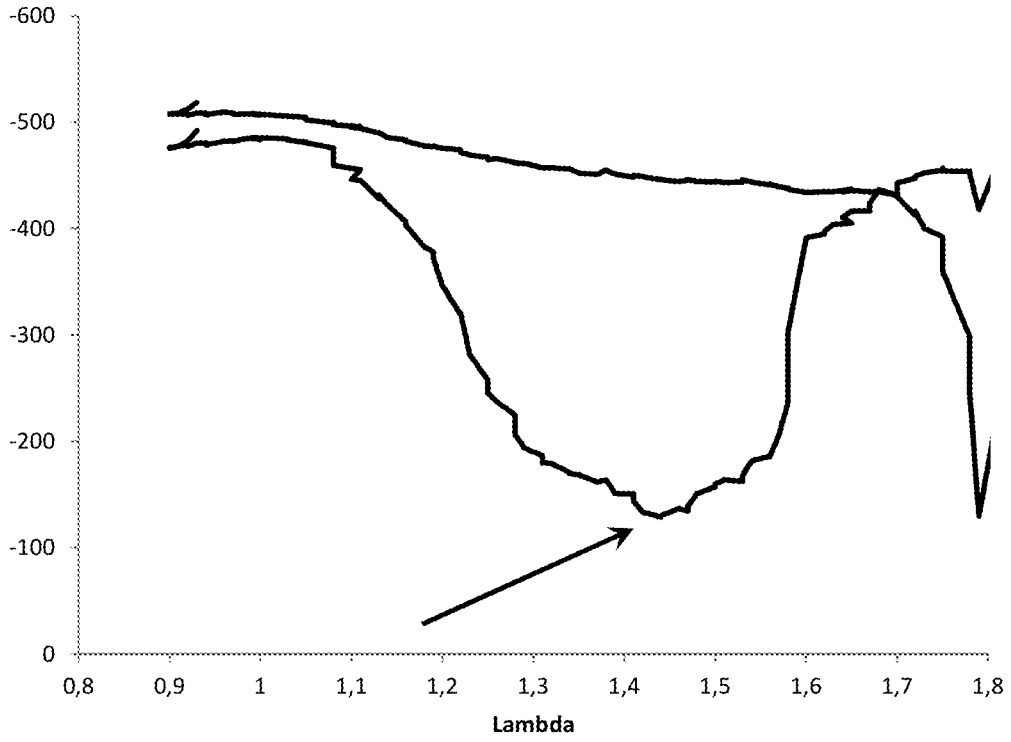
FIG. 5 shows two measurement curves of the aforementioned two ionization electrodes, wherein only the heat exchanger surrounding the burner surface is connected to ground.

The diagrams of FIGS. 3 to 5 show exemplary measurements that illustrate the course of the curves. The measured values are greatly dependent on the given dimensions of each of the components of the burner assembly or e.g. also on the power at which the burner is operated.

FIG. 3 shows two ionization voltages that have been measured by means of the two ionization electrodes 4, 4' of the embodiment of FIG. 2.

The voltages (on the y-axis, the voltages are plotted with a negative sign) each have been measured with respect to the burner surface 2', which was connected to ground. Thus, this measurement corresponds to the prior art. In the measurements, the heat exchanger 3 each was electrically isolated from the burner surface 2'. The x-axis shows the lambda value increasing from left to right. Thus, the mixture becomes leaner from left to right.

It is shown how proceeding from a maximum (designated by an arrow) in the region of lambda=1, the voltage values each become smaller with increasing lambda value—hence a lean fuel-air ratio. This course of the signal falling from a maximum is reproducible in general and is known from the prior art.

FIG. 4 shows the courses of the voltage values when the voltages are measured between the respective ionization electrode 4, 4' on the one hand and both the burner surface 2' and the surrounding heat exchanger 3 of the embodiment of FIG. 2 on the other hand. In contrast to the measurements of FIG. 3, the burner surface 2' and the heat exchanger 3 are electrically connected to each other and thus to the same ground.

The upper curve was measured by means of the ionization electrode 4', which is positioned closer to the burner surface 2'. The lower curve originates from the measurement by the ionization electrode 4 located further away from the burner surface 2'.

It can be clearly seen that the voltage of the ionization electrode 4' located closer to the burner surface 2' shows the known falling course of the ionization signal.

The ionization signal of the ionization electrode 4 located further away initially is falling proceeding from the maximum at lambda=1, in order to then rise again after a local minimum—which here accordingly is the local extremum sought for. In the further—non-illustrated—course of the measurement curve, the amplitude of this ionization signal, too, is falling towards zero like in the curve of the ionization electrode 4' located closer to the burner surface 2'.

Thus, in this leaned area a local minimum is obtained, which is used for calibration. In the Figure, this minimum is designated by an arrow.

A number of experiments have revealed that the local minimum mostly occurs between lambda=1.4 and lambda=1.6. In the measurement shown here, the minimum approximately lies at lambda=1.55.

The ionization signal increases again after passing through the minimum, in order to then decrease again. These larger lambda values also show a strong lift-off of the flame from the burner surface.

Experiments have shown that the position and the expression of the minimum in the lean range also depend on the surface load of the burner (quotient of supplied energy and usable burner surface). In one embodiment it therefore is provided that with each change of the power at which the burner 2 is operated, a new determination of the control parameters, i.e. a new calibration, is made.

A method for calibration—and hence for example as part of the method of monitoring the burner or of controlling the burning process—consists in that the air-fuel mixture is leaned and that a local minimum of the ionization signal between the ionization electrode and the heat exchanger as an example for a surrounding counter-electrode is sought for. The minimum then is used for calibration in order to be able to finally monitor the burning behavior of the burner by means of the calibration data or to control the burning process. A great advantage consists in that the calibration is made in the leaned area.

Alternatively, a setpoint value is calculated proceeding from the minimum, which—in particular in dependence on the performance or surface load of the burner—is higher by a previously fixed value, and is then used as a control variable.

FIG. 5 shows the course of the ionization voltages measured by means of the two ionization electrodes 4, 4' for the case that only the heat exchanger 3 as a counter-electrode to the respective ionization electrode 4, 4' is electrically connected to ground and galvanically separated from the burner surface 2'. Like in the two preceding Figures, the negative voltage is plotted on the y-axis and the lambda value increasing from left to right is plotted on the x-axis.

The upper curve belongs to the ionization electrode 4' of FIG. 2, which is located closer to the burner surface 2'. There is the known maximum around the area with lambda=1 and the decrease in the direction of increasing lambda values.

What is different therefrom is the course of the lower curve which has been measured by means of the ionization electrode 4 located centrally between the burner surface 2' and the counter-electrode 3. Here as well, a maximum is present at lambda=1. In the lean area, the amount of the amplitude of the measured voltage decreases in order to pass a minimum as an extremum in the area indicated with the arrow. After this minimum, the curve rises again in order to again fall off towards zero in the area—not shown here—with larger lambda values.

Thus, an extremum appears here as well, which can serve the calibration and determination or correction of the control parameters.

LIST OF REFERENCE NUMERALS

1 burner assembly
2 burner
2' burner surface
3 heat exchanger
4, 4' ionization electrode
5 air-fuel mixture supply
6 control device

The invention claimed is:

1. A method of monitoring a burner and/or a burning behavior of a burner, the method comprising:

measuring ionization signals, wherein the measured ionization signals are used for monitoring the burner and/or the burning behavior of the burner, wherein the ionization signals are respectively measured by the ionization electrode by using the burner surface and the heat exchanger as a common counter-electrode, wherein for a calibration and/or for a determination of parameters used when monitoring the burner, the ionization signals are measured during a hyperstoichiometric combustion, and that a local extremum of the ionization signals is determined during the hyperstoichiometric combustion in dependence on a lambda-value of an air-fuel mixture supplied to the burner and is used for the calibration and determination.

2. The method according to claim 1, wherein one of the ionization signal is measured between the ionization electrode and the counter-electrode by electrically connecting the counter-electrode and the burner surface to ground.

3. A burner assembly comprising:

a burner, a heat exchanger, at least one ionization electrode, an air-fuel mixture supply unit for the burner, and a control device, wherein the control device is connected to the at least one ionization electrode, wherein, based on ionization signals measured by the at least one ionization electrode, the control device monitors the burner and/or a burning behavior of the burner, wherein for monitoring the burner and/or a burning behavior of the burner the control device uses ionization signals measured by the ionization electrode by using the burner surface and the heat exchanger as a common counter-electrode, respectively, wherein for a calibration and/or for a determination of parameters used when monitoring the burner, the control device leans the air-fuel mixture supplied to the burner via the air-fuel mixture supply unit, and evaluates ionization signals measured by the leaned air-fuel mixture, and that for the calibration or the determination of the parameters the control device determines a local extremum of the ionization signals by the leaned air-fuel mixture.

4. The burner assembly according to claim 3, wherein the ionization electrode is arranged in an area of plus/minus 20% around a mean distance between the burner surface and the heat exchanger.

* * * * *